US005100710A

United States Patent [19]

Rizzuto

[11] Patent Number: 5,100,710

[45] Date of Patent: Mar. 31, 1992

[54] DISPOSABLE BIB

[75] Inventor: Peppino Rizzuto, Stevens Point, Wis.

[73] Assignee: Apix International, a division of Worzalla Publishing Co., Stevens Point, Wis.

[21] Appl. No.: 640,526

[22] Filed: Jan. 11, 1991

Related U.S. Application Data

[63] Continuation-in-part of Ser. No. 399,872, Aug. 30, 1989, abandoned.

[51] Int. Cl.[5] ..... A41B 13/10; B32B 3/10

[52] U.S. Cl. ..... 428/43; 2/49 R; 206/390; 428/131

[58] Field of Search ..... 428/43, 80; 2/49 R; 206/390, 820

[56] References Cited

U.S. PATENT DOCUMENTS

| | | | |
|---|---|---|---|
| D. 232,134 | 7/1974 | Andersson | D2/226 |
| D. 232,276 | 8/1974 | Andersson | D2/226 |
| D. 238,521 | 1/1976 | Andersson | D2/229 |
| 1,898,950 | 2/1933 | Goldberger . | |
| 2,172,162 | 9/1939 | Gillette | 2/49 |
| 2,299,232 | 10/1942 | Heyser | 2/49 |
| 2,424,680 | 7/1947 | Doyle | 2/49 |
| 2,498,471 | 2/1950 | Williams | 2/49 R |
| 2,763,867 | 9/1956 | Chagnon | 2/49 |
| 2,949,611 | 8/1960 | Wilkaitis | 2/49 |
| 3,001,646 | 9/1961 | Cooper | 206/58 |
| 3,146,464 | 9/1964 | Burnett | 2/49 |
| 3,146,465 | 9/1964 | Hummel | 2/49 |
| 3,299,440 | 1/1967 | Grable | 2/49 |
| 3,416,157 | 12/1968 | Marder et al. | 2/49 |
| 3,452,363 | 7/1969 | Schultz | 2/49 |
| 3,793,644 | 2/1974 | Kellner | 2/49 R |
| 3,851,760 | 12/1974 | Smith | 242/55.53 |
| 3,999,221 | 12/1976 | Hannigan | 2/49 R |
| 4,186,443 | 2/1980 | Britzman | 2/49 R |
| 4,523,334 | 6/1985 | Lavash | 2/49 R |
| 4,543,668 | 10/1985 | Franklin | 2/49 R |
| 4,622,698 | 11/1986 | Heyman et al. | 2/49 R |

*Primary Examiner*—Alexander S. Thomas
*Attorney, Agent, or Firm*—Foley & Lardner

[57] ABSTRACT

A blank is provided for forming a disposable bib which can be dispensed from a roll or identical bibs. The blank is a sheet-like structure which has a neck portion forming an upper end thereof and an identical lower projecting portion forming a lower end thereof. Two selvedge portions form the side of the sheet-like structure, the inner boundaries of the selvedge being perforated so that when the perforation is broken, the selvedge portion ties around the neck of the user. The remainder of the blank forms the principal portion of the bib for catching food and the like.

6 Claims, 4 Drawing Sheets

DISPOSABLE BIB

This application is a continuation-in-part of U.S. application Ser. No. 399,872, filed Aug. 30, 1989, now abandoned.

BACKGROUND OF THE INVENTION

1. Field of the Invention

The present invention relates to bibs, and more particularly, to a plurality of disposable bibs stamped from a continuous web of stock.

2. Discussion of the Related Art

Bibs which are known in the art take on a variety of different forms. Disposable bibs, which are used in restaurants, for example, are often stamped from a length of continuous stock so that a plurality of bibs may be formed from a continuous length of material. The stock is then wound around a spool and sold as a roll.

For example, U.S. Pat. No. 3,299,440 discloses a bib wherein a plurality of bibs are stamped on a length of material and wound into a roll. The bibs have upper extending portions stamped from the sides of the preceding bib which then form the neck tie portion of the successive bib. A similar design is disclosed in U.S. Pat. No. 4,622,698.

The disadvantage of these designs is that, because of the long upwardly extending neck ties, it is difficult to pull the bib off the roll without tearing the neck ties. Also, since the neck tie portion extends far into the next bib, the roll must be unwound each time thereby exposing at least two bibs.

U.S. Pat. No. 232,276 discloses a bib having downwardly extending neckties. However, the bib does not appear to be formed from a continuous length of material. Furthermore, the bib is formed with a straight top and bottom portion, which does not very easily conform to the shape of the user's neck.

SUMMARY OF THE INVENTION

Accordingly, it is an object of the present invention to provide a bib which can be dispensed from a roll of continuous stock.

A further object of the present invention is to provide a bib design wherein no material is wasted.

A further object of the present invention is to provide a bib design wherein the bib can easily be dispensed from a roll without tearing the bib.

The foregoing and additional objects are attained by providing a blank for forming a disposable bib which can be dispensed from a roll of identical bibs. The blank is a sheet-like structure which has a neck portion forming an upper end thereof and an identical lower projecting portion forming a lower end thereof. Two selvedge portions form the side of the sheet-like structure, the inner boundaries of the selvedge being perforated so that when the perforation is broken, the selvedge portion ties around the neck of the user. The remainder of the blank forms the principal portion of the bib for catching food and the like.

Further objects and advantages of the present invention will become apparent from the specification and drawings which follow.

DETAILED DESCRIPTION OF THE PREFERRED EMBODIMENTS

Figure 1:
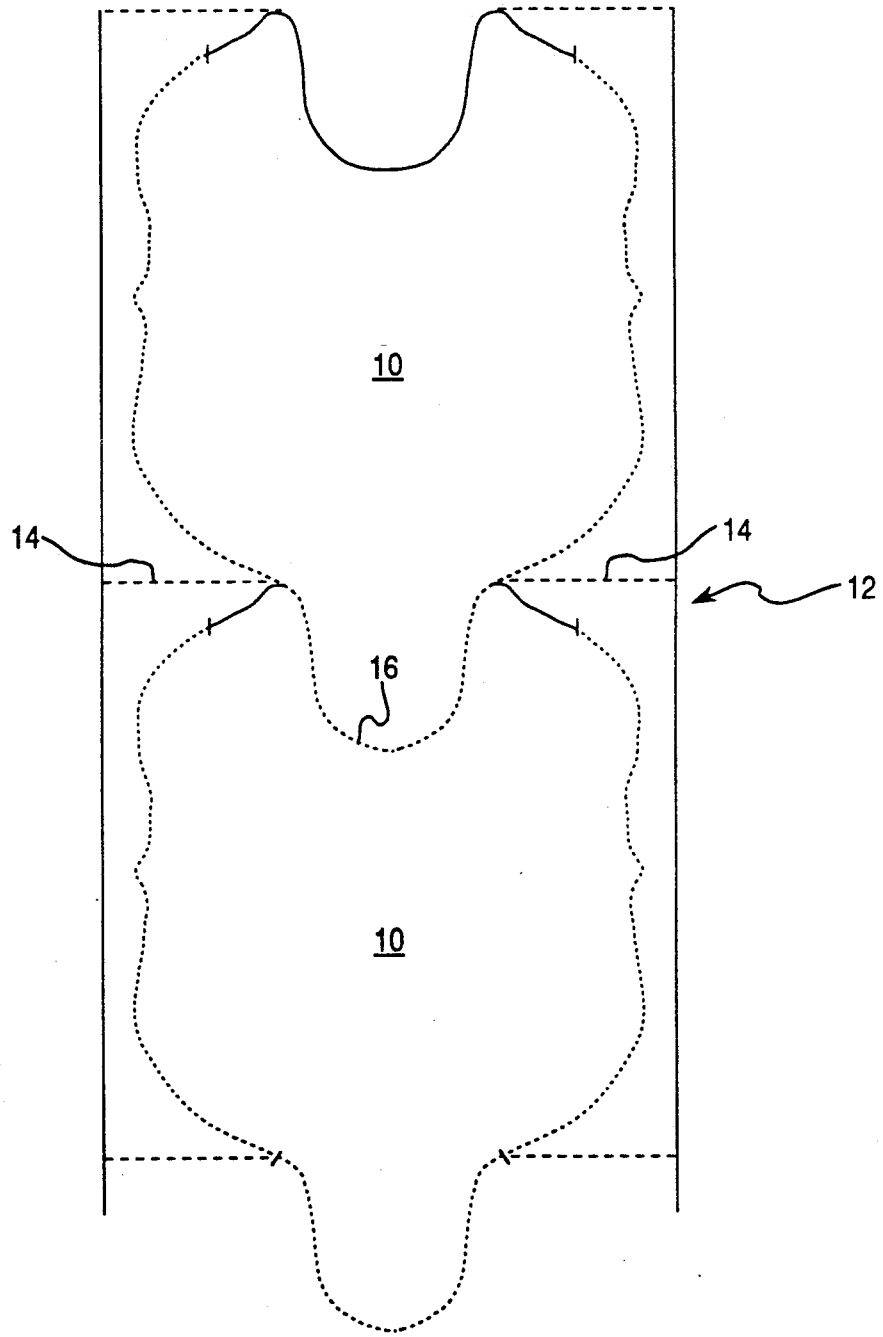
FIG. 1 is a view of a plurality of disposable bibs which are stamped on a continuous length of material according to a first preferred embodiment of the present invention.

Referring to FIG. 1, the a first preferred embodiment of present invention contemplates a plurality of disposable bibs 10 which are stamped from a continuous web of sheet-like material 12. The sheet-like material 12 may advantageously be formed of an upper liquid-absorbent layer facing away from the user and a lower non-absorbent layer facing the user. The non-absorbent layer keeps the user dry and adds strength to the bib. The bibs 10 may be separated from each other along perforation 14 and neck perforation 16.

Figure 2:
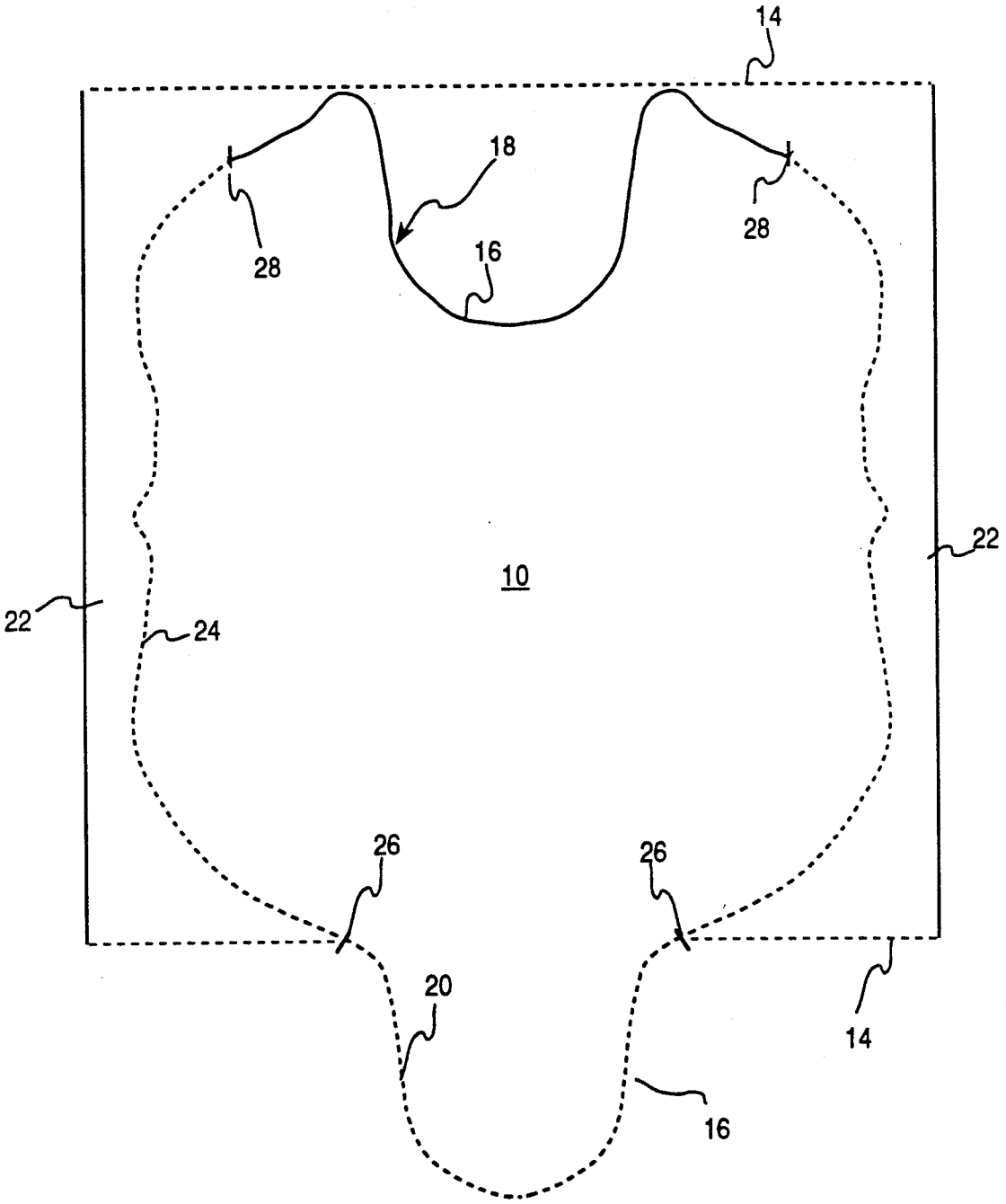
FIG. 2 is a front elevation view of a bib which has been removed from the length of material shown in FIG. 1 according to a first preferred embodiment of the present invention.

A single bib after removal from the length of material 12 is shown in FIG. 2. As can be seen, the bib is symmetrical about an axial centerline. A neck portion 18 forms an upper end of a bib, while a lower projecting portion 20 forms a lower end of the bib. As can be seen, the lower projecting portion and upper neck portion are of identical shape and dimension. The reasons for this are obvious: as seen from FIG. 1, the lower projecting portion and upper neck portion are coterminous both being formed from the same perforation 16, thereby defining the same shape.

Two identical neck tying portions 22 are formed from what would otherwise be the selvedge of the piece of material. Thus, no material is wasted. The inner boundary of the selvedge tie portion, as well as the outer boundary of the principal portion of the bib 10, are formed from a perforation 24. The perforation 24 extends from termination point 26 of the lower projecting portion to an upper point 28 spaced from the neck portion 18 of the bib.

Figure 3:
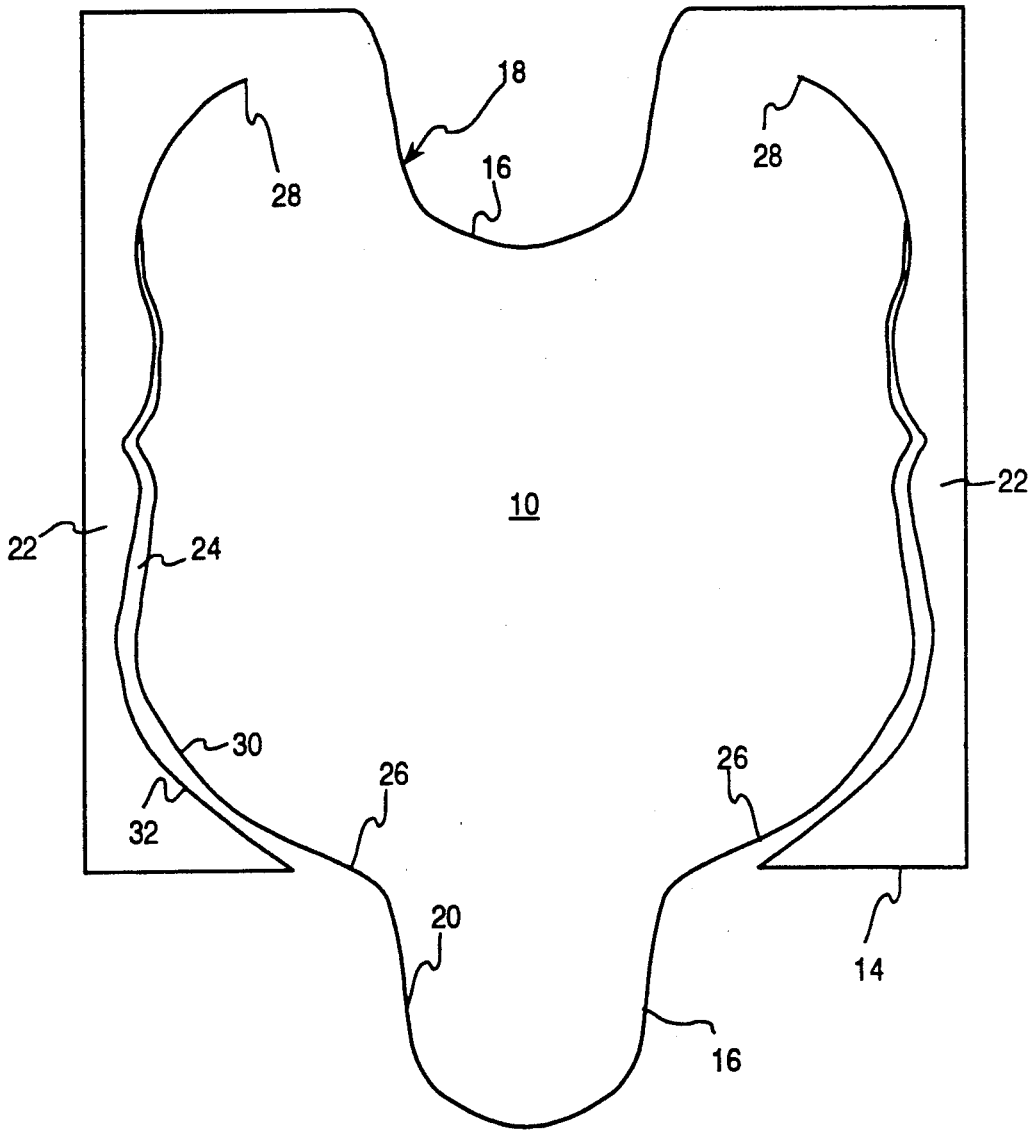
FIG. 3 is a front elevation view of the single bib of FIG. 2 wherein the inner perforated boundary of the selvedge portion has been broken according to a first preferred embodiment of the present invention.

As seen in FIG. 3, when the selvedge tie portion 22 is separated along perforation 24, the outer boundary 30 of the major portion of the bib 10 is separated from the inner boundary 32 of the selvedge tie portion 22. The selvedge tie portion 22 may then be tied around the user's neck.

The construction according to the first preferred embodiment of the present invention provides a simple bib design which is inexpensive to produce. The cost savings are further enhanced by the fact that no material is wasted. Also, the construction of the present invention allows the individual bibs to easily be pulled from a roll without ripping the selvedge tie portion or any other portion from the remainder of the bib. Furthermore, due to the compact design of the present invention, only one bib length need be pulled from the roll at a time.

Figure 4:
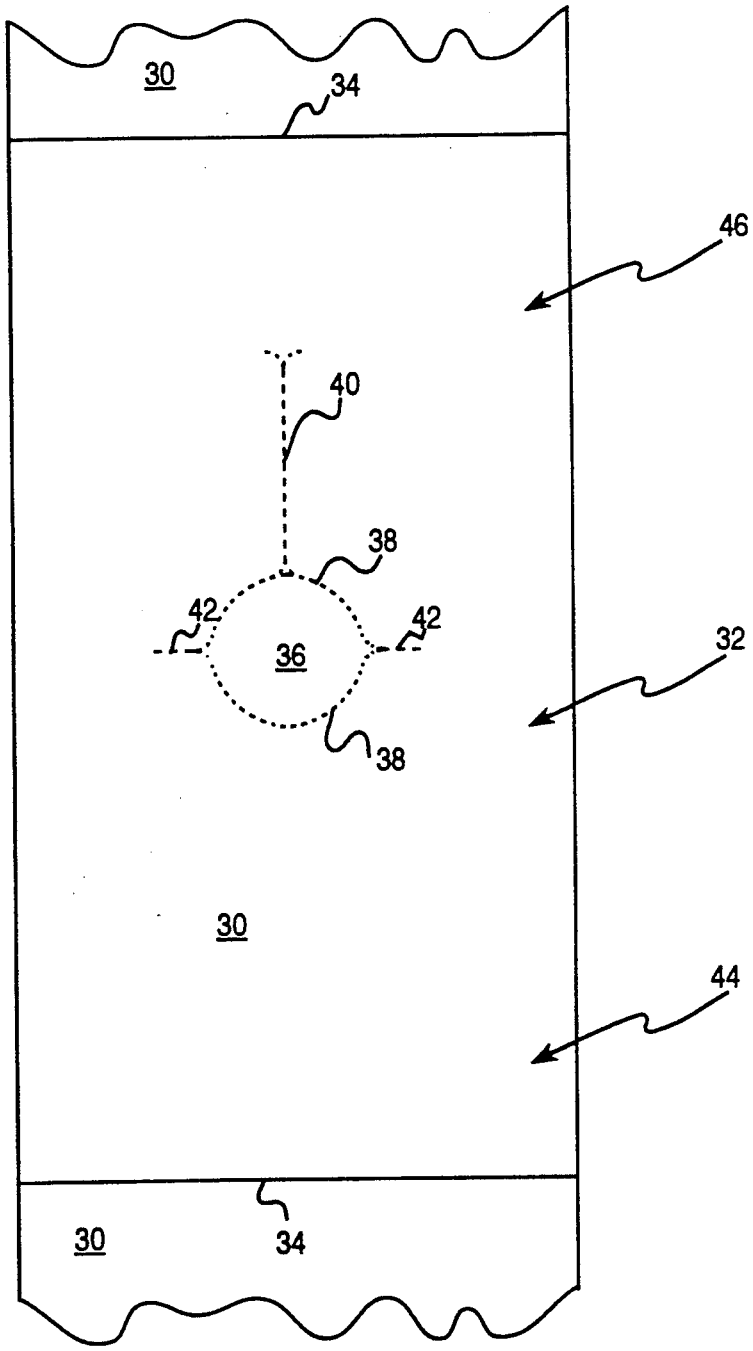
FIG. 4 is a front elevation view of a disposable bib according to a second preferred embodiment of the present invention.

FIG. 4 shows a second preferred embodiment of the present invention. A plurality of bibs 30 are formed from a continuous sheet-like substrate 32. The substrate 32 is preferably biodegradable and, for the same reasons as the first preferred embodiment, may advantageously be formed form an upper liquid-absorbent layer facing away from the user and a lower non-absorbent layer facing the user. The non-absorbent layer keeps the user dry and adds strength to the bib. The bibs 30 may be arranged in a roll and separated from each other along perforations 34.

Each bib 30 has a neck portion 36 formed therein, which is bounded by perforations 38. The part of the bib 30 forming the neck portion 36 may be removed prior to arranging the bibs in a roll or may be removed by the user when an individual bib is removed from the roll. Extending from the neck portion 36 are a plurality of extension perforations. The embodiment shown in FIG. 4 includes a back extension perforation 40 and two shoulder perforations 42. The sum of the length of the back extension perforation and the width of the neck portion should be sufficient to allow passage of the user's head therethrough. These extension perforations allow the same bib construction to be used on children of different ages and sizes.

In use, the bib 30 is detached by the user from a subsequent bib along perforation 34. If not already removed, the user removes the neck portion 36 by perforating along line 38. The user then tears the extension perforations 40 and 42 as needed to allow passage of the head through the hole formed by the removal of the neck portion 36. The lower half 44 of the bib 30 drapes over the front of the user, while the upper half covers the user's back.

It will become obvious to those of ordinary skill in the art that the present invention is not limited to the preferred embodiments shown and described.

What is claimed is:

1. A disposable bib comprising:

a sheet-like substrate having a first end and a second end; said sheet-like substrate having a perforated neck portion formed in a central portion thereof; said perforated neck portion being dimensioned to allow passage of a neck therethrough; a plurality of perforated extension lines extending from said perforated neck portion, said plurality of extension lines including a head extension line extending toward said first end, the sum of the length of said head extension line and the width of said neck portion being sufficient to allow passage of a head therethrough, wherein said plurality of perforated extension lines includes a pair of shoulder extensions extending substantially parallel to said first and second ends.

2. The disposable bib of claim 1, wherein said substrate is formed from a first liquid absorbent layer and a second nonabsorbent layer.

3. The disposable bib of claim 2, wherein said substrate includes a means for strengthening said bib.

4. A continuous structure for forming a plurality of disposable bibs, comprising:

a plurality of blanks, each of said blanks comprising a sheet-like substrate having a first end and a second end; said sheet-like substrate having a perforated neck portion formed in a central portion thereof; said perforated neck portion being dimensioned to allow passage of a neck therethrough; a plurality of perforated extension lines extending from said perforated neck portion, said plurality of extension lines including a head extension line extending toward said first end, the sum of the length of said heat extension line and the width of said neck portion being sufficient to allow passage of a head therethrough; each said blank being perforated at respective first and second ends thereby permitting separation of adjacent blanks, wherein said plurality of perforated extension lines includes a pair of shoulder extension extending substantially parallel to said first and second ends.

5. The disposable bib of claim 4, wherein said substrate is formed from a first liquid absorbent layer and a second nonabsorbent layer.

6. The disposable bib of claim 4, wherein said substrate includes means for strengthening said bib.

* * * * *